United States Patent [19]

Emmons

[11] 4,113,154

[45] Sep. 12, 1978

[54] CONVERTIBLE HAT BLOCKING STRUCTURE

[76] Inventor: Marvin L. Emmons, 2463 NW. Dallas St., Grand Prairie, Tex. 75050

[21] Appl. No.: 775,245

[22] Filed: Mar. 7, 1977

[51] Int. Cl.[2] ..... A42C 1/00

[52] U.S. Cl. ..... 223/24

[58] Field of Search ..... 223/12–26, 223/84

[56] References Cited

U.S. PATENT DOCUMENTS

| | | | |
|---|---|---|---|
| 1,931,688 | 10/1933 | Dusopoulos | 223/25 |
| 2,072,925 | 3/1937 | Solosko | 223/25 |
| 2,370,510 | 2/1945 | Winsen | 223/24 |

FOREIGN PATENT DOCUMENTS

| | | | |
|---|---|---|---|
| 652,611 | 10/1928 | France | 223/24 |
| 701,303 | 12/1940 | Fed. Rep. of Germany | 223/24 |

*Primary Examiner*—Doris L. Troutman
*Attorney, Agent, or Firm*—John J. Leavitt

[57] ABSTRACT

Presented is a hat blocking structure that is convertible to provide for the blocking of different styles of brims with different styles of crowns on hats to be blocked.

1 Claim, 8 Drawing Figures

CONVERTIBLE HAT BLOCKING STRUCTURE

BACKGROUND OF THE INVENTION

1. Field of the Invention

This invention relates to hats of the type that are required to be blocked to provide a selected crown and brim sytle, and particularly to apparatus that is convertible to provide a selection of different brim styles with different crown styles.

2. Description of the Prior Art

The prior art with respect to this invention is believed to be fairly represented by the following U.S. Pat. Nos. 1,361,658; 1,630,803; 1,506,414; 1,650,571; 1,720,602; 1,888,375; 1,914,864; 1,931,688; 1,949,828; 1,976,711; 2,142,554; 2,281,546; While as a group, these patents relate to the general subject matter of hat blocking, only one of these, namely, U.S. Pat. No. 1,931,688, appears to be pertinent to the concept of a convertible hat blocking apparatus. Even so, while the end result produced by the hat block depicted by U.S. Pat. No. 1,931,688 may be similar to the end result produced by the subject invention, the means by which such end result is achieved are wholly different.

Accordingly, one of the objects of the invention is to provide a hat blocking structure that is easily convertible from one crown style to another and one brim style to another to provide a wide range of style choices.

Another object is to provide a hat blocking structure that is simple and inexpensive and easy to use.

Still another object of the invention is the provision of a hat blocking structure which itself provides visual confirmation to a customer of the ultimate style of hat crown and brim.

The invention possesses other objects and advantages, some of which, with the foregoing, will be apparent from the following description and the drawings. It is to be understood, however, that the invention is not limited to the embodiment illustrated and described, since it may be embodied in various forms within the scope of the appended claims.

SUMMARY OF THE INVENTION

In terms of broad inclusion, the convertible hat blocking structure of the invention comprises means for use to shape the completed and normally unshaped or unblocked hat so as to impart to the hat the style selected by the buyer. Most hats are fabricated from appropriate fibers, some being "felt" type hats, others being leather-like, while others are formed from straw-type materials. All such hats are susceptible to shaping into desirable styles by applying hot steam to the fibrous mass forming the hat until the fibers have softened and lost their "memory". Once this softening or loss of memory of the fibers has occured, one conventional method of shaping the hats is to mold them by hand into the shape desired. With respect to sizing of the inner periphery of the brim and crown of a hat, this is conventionally carried out on appropriate apparatus that stretches the mass of fiber until the desired size has been obtained as indicated in some of the patents noted above. So far as known, there is no apparatus that simultaneously permits shaping of the crown and brim, and which is convertible to provide different crown styles with different brim styles.

DESCRIPTION OF THE PREFERRED EMBODIMENT

Figure 1:
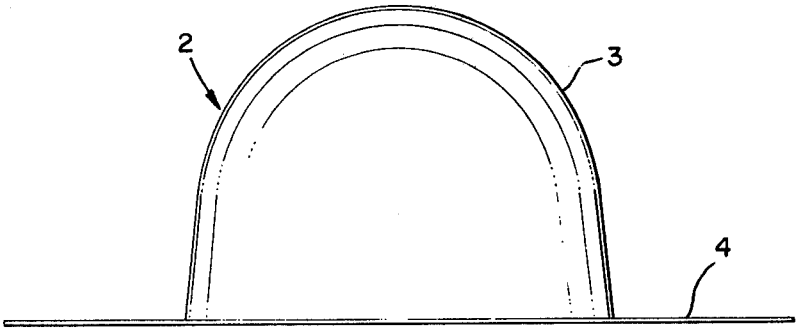
FIG. 1 is a side elevation view of an unblocked hat.

Referring to FIG. 1, there is there shown, designated generally by the numeral 2, an unformed or unblocked hat having a crown portion 3 and a brim portion 4. As indicated previously, the hat may be assumed to be fabricated from felt-like material which may be formed into any selected style by the application of steam heat to the fiber mat forming the hat and then shaping the hat while the fiber is in a "no memory" condition as a result of such steam heating.

As indicated previously, the particular style into which a hat is shaped is conventionally done by hand, so that each hat, even when it is intended that it be formed in the same style, is somewhat different, or lacking in uniformity with other such hats of the same style. This occurs because when styling is effected by hand and without using any kind of a guide, there are bound to be dissimilarities in the ultimate shape to which the hat is formed.

Figure 2:
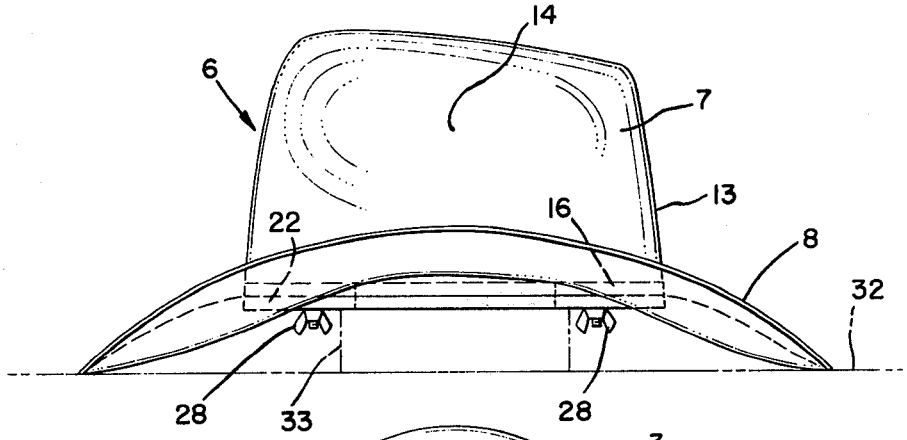
FIG. 2 is a side elevational view of the hat blocking structure of the invention.
Figure 4:
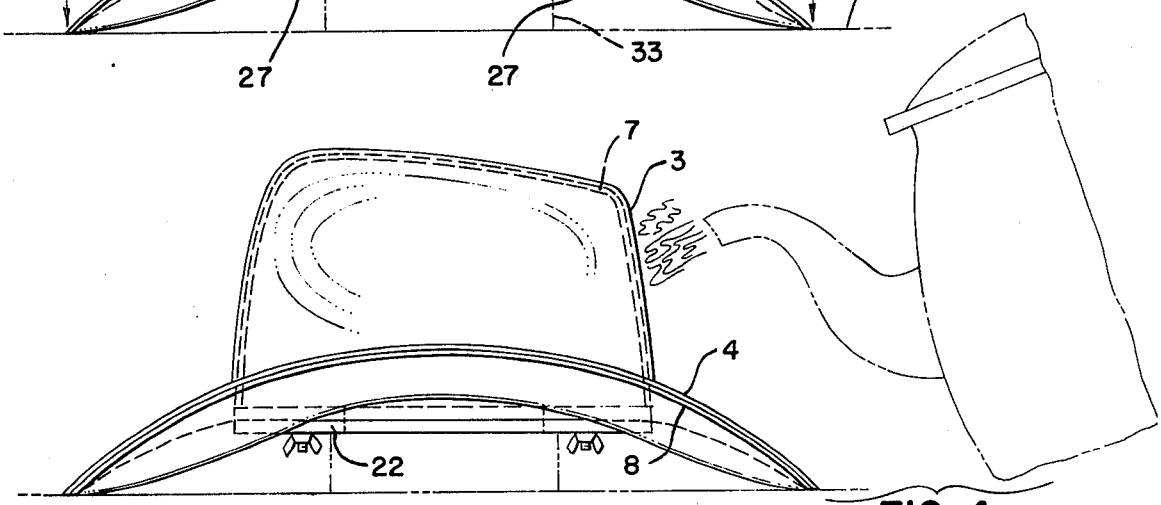
FIG. 4 is a side elevational view of my hat blocking structure with a hat draped thereover, and illustrating one method of applying hot steam so as to soften the hot fibers and cause them to conform to the configuration of the hot blocking structure.
Figure 5:
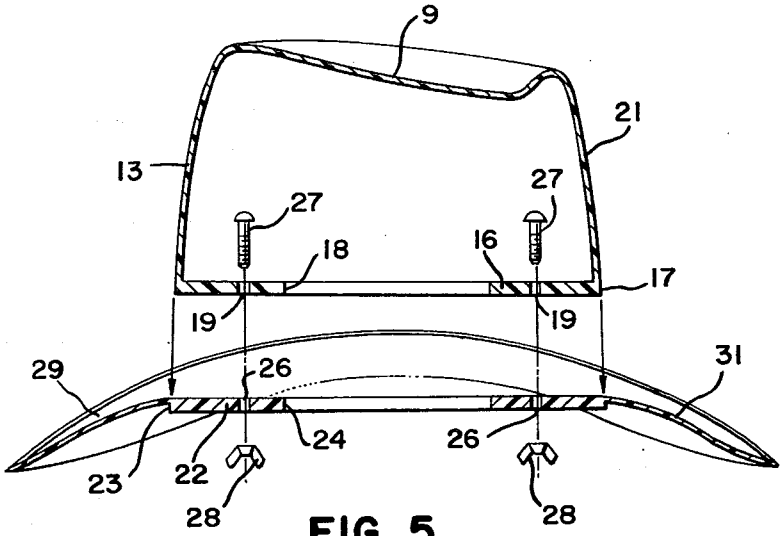
FIG. 5 is vertical cross-sectional view through the crown and brim portions of my hat blocking structure, shown separated for clarity.
Figure 6:
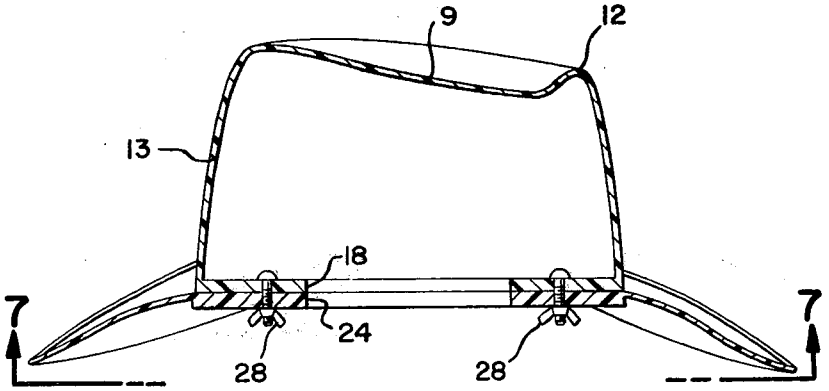
FIG. 6 is a vertical cross-sectional view showing the crown and brim portions detachably secured together.

To obviate such dissimilarities, and to insure that each hat shaped into a particular style will be exactly the same as others, the subject matter of this invention comprises a rigid hat-shaped blocking structure designated generally by the numeral 6 in FIG. 2, and including a crown portion 7 and a brim portion 8. In this instance, the crown portion of the hat blocking structure is provided with a top surface 9 that is centrally depressed as illustrated in FIGS. 5 and 6, the depressed surface 9 being surrounded by a rolled portion 12 which extends completely around the depressed portion and which is somewhat greater in depth adjacent the rear of the hat as seen on the right hand side in FIGS. 2 through 6, and gradually decreasing in depth as the top surface 9 approaches the forward end of the hat as viewed on the left hand side of the figures in FIGS. 2 through 6, so that the forward portion of the crown of the hat blocking structue for this style crown normally projects somewhat higher than the rear portion of the crown as illustrated.

The crown portion of the hat-shaped blocking structure is also provided with generally ovate walls 13 tapering upwardly to merge smoothly with the top surface 9. As illustrated in FIGS. 2 and 4, the two opposite sides of the ovate walls 13 are depressed toward each other to provide a recess 14 on each side of the crown portion. Formed integrally with the lower end of the ovate wall 13 is a radially inwardly extending annular mounting member 16 the outer periphery 17 of which is integral with the lowermost edge of the ovate wall 13, while the inner periphery 18 of the annular mounting member 16 defines an aperture opening into the hollow interior of the crown portion of the hat-shaped blocking structure. As illustrated in FIGS. 5 and 6, the radially inwardly extending mounting member 16 is provided with a pair of apertures 19 adjacent the front and rear of the hat-shaped blocking structure for purposes which will hereinafter be explained.

It will thus be seen that the crown portion of the hat shaped-blocking structure, without more, constitutes a rigid structure, preferably fabricated from an appropriate synthetic resinous material reinforced, for instance, with fiberglass, and on its exterior surface 21, conforms to the shape of a desired hat style. Thus, the crown portion of the hat-shaped blocking structure may be utilized to effectively provide a form on which the crown of an unblocked or unshaped hat may be supported so as to initially provide a desired crown shape, or to reconstruct one that has become misshapen.

However, for maximum utility, the crown portion of the hat-shaped blocking structure is utilized in conjunction with a detachable brim portion designated generally by the numeral 8 and including a centrally disposed mounting flange portion 22 having an outer periphery 23 and an inner periphery 24 as shown. Also provided in the mounting flange portion 22, which is preferably in the form of an annulus that conforms to the configuration of the annular mounting flange member 16 associated with the open end of the crown portion, are a plurality of apertures 26 positioned in the mounting flange member 22 so as to be in alignment with the apertures 19 in the mounting flange member 16 associated with the crown portion. Thus, when the apertures 19 and 26 are aligned, the inner and outer peripheries of the two mounting portions 16 and 22 are generally in registry with each other and the two mounting portions may then be detachably secured together by an appropriate bolt 27 dimensioned to pass snugly through the apertures 19 and 26, and which may be secured therein so as to provide a clamping action between the two mounting portions by an appropriate thumb nut 28.

Extending radially outwardly from and integral with the outer periphery 23 of the brim mounting flange 22, is a brim support portion 29 formed, like the mounting portion 22 and the crown portion previously discussed, from a rigid synthetic resinous material, preferably reinforced with glass fiber. The brim support portion 29 is sculptured to provide on its top surface 31 the configuration desired for a particular style of hat brim.

Figure 3:
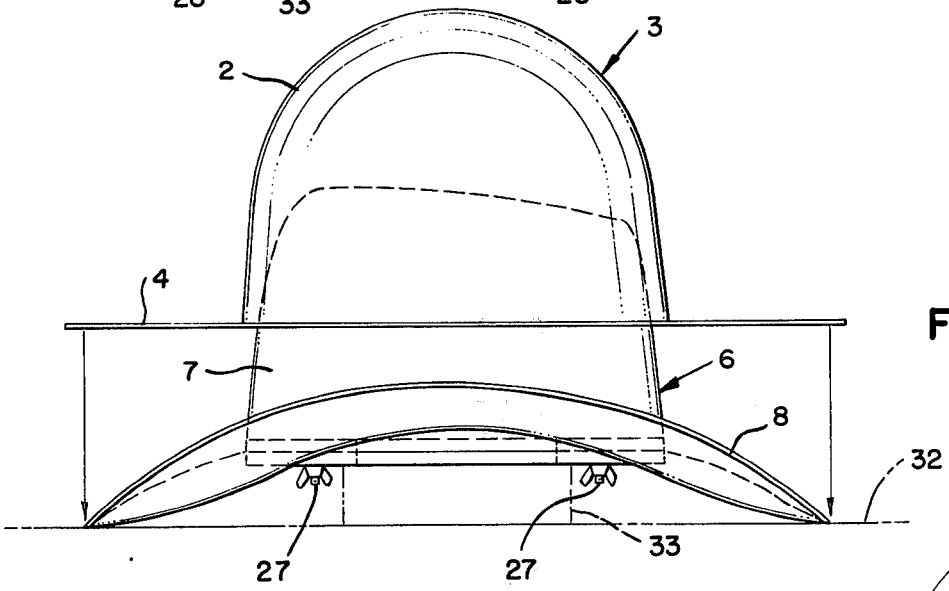
FIG. 3 is a view similar to FIG. 2, but showing an unblocked hat partially draped over the blocking structure of the invention.

Thus, as illustrated in FIG. 3, in use the hat-shaped blocking structure which includes the crown portion and the brim portion detachably bolted together as illustrated in FIG. 6, is appropriately supported on a flat surface such as a table top 32 with or without a pedestal 33 extending between the table top and the under side of the brim mounting portion 22 to firmly support the hat-shaped blocking structure on the table top. An unblocked or unshaped hat 2 is then lowered over the crown portion as illustrated in FIG. 3 until the brim of the hat comes to rest on the hat brim support portion 29. At this point, the hat draped over the hat-shaped blocking structure is subjected to the application of hot steam, as illustrated in FIG. 4, so as to soften the fibers and cause them to lose their "memory."

It will be seen that as soon as sufficient moist heat has been applied to the hat, the crown of the hat may be molded by hand so that it conforms exactly to the depression formed in the top surface of the crown portion of the blocking structure, while the sides of the crown may be depressed to fill the depressions 14 formed in the ovate walls 13. In like manner, the brim of the hat may be molded so that it conforms to the configuration of the upper surface 31 of the brim support portion 29.

Once the desired style has been achieved by causing conformation of the hat to the shape of the hat-shaped blocking structure, the heat is removed and the hat is permitted to dry and cool while remaining on the hat-shaped blocking structure. This generally requires only a few minutes, especially if warm air, such as from a fan or hair dryer type apparatus is used to accelerate cooling and drying.

Figure 8:
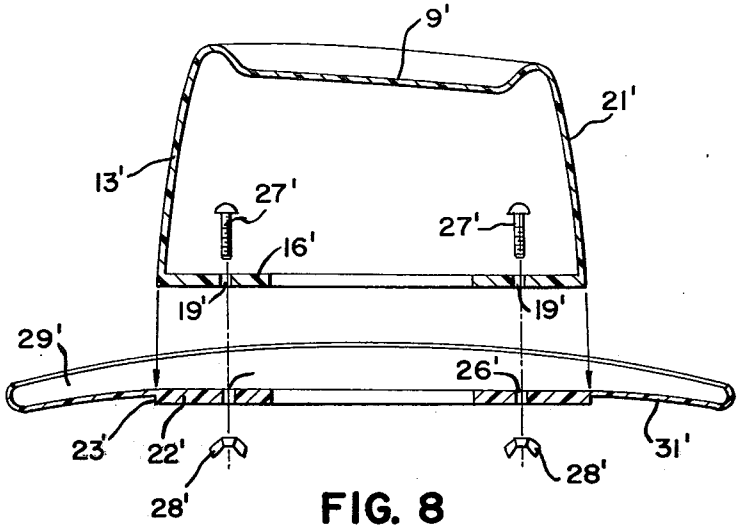
FIG. 8 is a vertical cross-sectional view similar to FIG. 5, showing the crown portion separated from the brim portion, and illustrating different style crown and brim portions.
Figure 7:
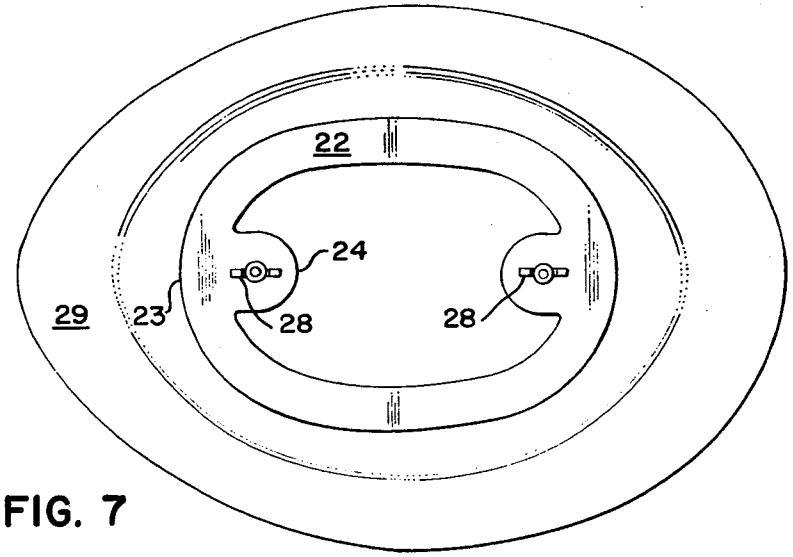
FIG. 7 is a bottom plan view illustrating the brim flange used to fasten the brim portion of the hat blocking structure to the crown poriton of the hat blocking structure.

It will of course be seen that any selected style of crown portion may be detachably interconnected with any selected style of brim support portion. Accordingly, as viewed in FIG. 8, a different style crown and different style brim are constructed in essentially the same manner, the crown portion and the brim portion being fabricated from a hard synthetic resinous material; preferably reinforced with fiberglass, and adapted to be detachably secured as previously discussed. In this way, a customer who purchases a hat has a greater range of styles to choose from, while the owner of the hat store is provided the facility of blocking the purchased hat in whatever style is selected.

Having thus described the invention, what is sought to be protected by letters patent of the United States is as follows:

I claim:

1. A convertible hat blocking structure for simultaneously blocking hats having a variety of styles of crowns and brims, said hat blocking structure comprising:

a crown portion selected from a plurality of differently styled crown portions, said selected crown portion constituting a rigid body having an open end and a hollow interior defined by a generally ovate side wall and a top surface, said side wall and top surface being selectively depressed inwardly so as to be configured in the form of a selected hat crown style;

means secured to and at least partially closing the open end of said crown portion and including spaced apertures to receive fasteners;

a brim portion selected from a plurality of differently styled brim portions, said selected brim portion constituting a rigid body having an inner portion conforming generally in size and shape to the open end of the crown portion and an outer brim support portion extending radially outwardly from and integral with said inner portion, said brim support portion providing on its top surface a configuration corresponding to a selected hat brim style, said inner portion including spaced apertures to receive fasteners; and fastener means interposed between said means closing the open end of said crown portion and said brim portion and passing through corresponding spaced apertures therein for detachably fastening said crown and brim portions together in superposed relationship with said crown portion resting on the upper surface of said brim portion to produce a hat blocking structure having selected crown and brim portions which individually conform to selected crown and brim styles whereby a hat to be blocked may be draped over said crown and brim portions and be molded to the configuraton thereof to provide a hat having said selected crown and brim styles.

* * * * *